US006502415B2

(12) United States Patent
Chiusolo

(10) Patent No.: US 6,502,415 B2
(45) Date of Patent: Jan. 7, 2003

(54) BEVERAGE COOLER

(75) Inventor: Sam Chiusolo, Port Perry (CA)

(73) Assignee: Icefloe Technologies Inc., Toronto (CA)

( * ) Notice: Subject to any disclaimer, the term of this patent is extended or adjusted under 35 U.S.C. 154(b) by 0 days.

(21) Appl. No.: 09/887,973

(22) Filed: Jun. 22, 2001

(65) Prior Publication Data

US 2002/0011076 A1 Jan. 31, 2002

Related U.S. Application Data

(63) Continuation-in-part of application No. 09/764,441, filed on Jan. 19, 2001.

(30) Foreign Application Priority Data

Jan. 20, 2000 (CA) ..... 2296579

(51) Int. Cl.[7] ..... F25D 23/12
(52) U.S. Cl. ..... 62/338; 62/392; 222/146.6
(58) Field of Search ..... 62/338, 339, 392, 62/396, 399; 222/146.6; 165/146, 147

(56) References Cited

U.S. PATENT DOCUMENTS

| | | | | |
|---|---|---|---|---|
| 34,648 A | 2/1862 | Sherman | | |
| 1,622,376 A | 2/1927 | Davenport | | |
| 2,223,152 A | 11/1940 | Nagin | 62/43 | |
| 2,271,648 A | 2/1942 | Kleist | 257/187 | |
| 2,917,906 A | 12/1959 | Woolley | 62/306 | |
| 4,225,059 A | 9/1980 | Kappos | 222/146 | |
| 5,079,927 A | 1/1992 | Rodino et al. | 62/99 | |

*Primary Examiner*—William E. Tapolcai
(74) *Attorney, Agent, or Firm*—Synnestvedt & Lechner LLP

(57) ABSTRACT

An apparatus is provided for cooling a carbonated beverage stored in a container and dispensing non-foamed carbonated beverage. A method of cooling and delivering non-foamed beverage with the apparatus is also provided. The beverage is preferably beer. The apparatus comprises a housing that has a number of chambers. A chamber can optionally be provided for receiving a number of beer kegs. A pressurizing device is attached to a beer keg for maintaining the beer under pressure in the keg. A conduit is received in one of the chambers and communicates between the beer keg and a tap located on the exterior of the apparatus. A water and ice cooling mixture is circulated over the conduit in the same chamber for cooling the conduit. A perforated vessel surrounds the conduit to protect the conduit and the agitators from being damaged by ice particles. At least two agitators for circulating the cooling fluid over the conduit are located in chamber where the conduit is received. The agitators are positioned to continuously circulate cold water over the conduit for maximum heat exchange.

9 Claims, 8 Drawing Sheets

BEVERAGE COOLER

CROSS-REFERENCE TO RELATED APPLICATIONS

This application is a continuation-in-part of U.S. application Ser. No. 09/764,441, filed Jan. 19, 2001, which claims priority to Canadian Application No. 2296579, filed Jan. 20, 2000.

FIELD OF THE INVENTION

The present invention relates to apparatuses and processes for cooling beverages and more particularly to a portable coolers having provision for reducing or eliminating the formation of foam in carbonated beverages.

BACKGROUND OF THE INVENTION

There are numerous events and activities where one desires to enjoy cool beverages. However, many such events and activities are located in places where there is no access to cool beverages chilled by traditionally means such as refrigerators. In particular, remote locations such as on the golf courses, sporting events, outdoor concerts and other outdoor activities, do not facilitate the easy distribution of cool beverages. Easy distribution of cool beverages is also desirable at resorts, bars and restaurants. Most consumers at these activities desire cool beverages. Numerous means have been developed to provide such beverages.

There exists in the prior art inventions which have a similar purpose as the subject invention. In particular U.S. Pat. No. 4,225,059 describes a portable beverage cooler and dispenser. The apparatus includes an air cylinder for pressurizing beer kegs. The beer kegs are located in a housing. The beer kegs are connected to a coiled dispensing hose also located in the housing. The hose passes through ice located in ice chambers. This serves to cool the beer before it is dispensed through spigots at the top of the apparatus. In addition, U.S. Pat. No. 2,223,152 describes a stationary beer cooling device. The device is not pressurized. The device cools the beer by circulating it through a cooling coil which is immersed in an ice water bath. The cooling coil is protected by a perforated metal sleeve so as to permit an operator to agitate the ice bath with a stick or a rod.

The drawback to both of these inventions is that they do not adequately cool and de-foam beer.

The most typical manner to provide cool beverages at remote locations is to transport canned beverages in coolers containing ice and distribute the canned beverages at the remote location. However, the use of canned beverages is more costly to the consumer and creates significant waste in the form of emptied cans. Further, the use of individual cans reduces the volume of beverage one is able to transport to such remote locations since the can packaging occupies the limited cooler space.

To address the problems associated with canned beverages there have been attempts to use kegs or other such large vessels to distribute cool beverages at remote locations. However, this method also has drawbacks. It is difficult to cool large vessels so that the beverages are of an acceptable temperature. Further, portable containers are often subject to severe agitation when they are traveling over hilly or rough terrain such as golf courses. A combination of elevated temperature and agitation causes the beverages to form foam. If the beverage is beer, the beer which discharges from the container will be in the form of foam. This ruins the taste of the beverage and makes it impossible to pour the beer properly due to excess foaming.

Since most beverages enjoyed by consumers are carbonated, minimizing foaming is of critical importance. When gas that is dissolved in a carbonated beverage leaves the liquid, it creates foam. The foam is often waste and is poured off before the beverage is served. If a carbonated beverage is not handled properly, 50% can be lost to foam waste. Further, even that portion of the carbonated beverage that does not foam will likely be of poor quality since the loss of carbonation will make the beverage less acidic or "flat".

Because the solubility of a gas in a liquid is higher at lower temperatures, the carbon dioxide gas is less likely to come out of solution and form foam at cooler temperatures. Accordingly, it is desirable to dispense carbonated beverages at cool temperatures.

Another means to minimize foaming is to maintain the carbonated beverage under a certain amount of pressure. This is true because the solubility of a gas in a liquid is higher at elevated pressures. When the pressure on a carbonated beverage is released or reduced the gas dissolved therein leaves solution more readily and creates foam.

Pressure can be maintained on carbonated beverages up to the point of dispensing it by forcing the beverage through a length of conduit of a lesser diameter than the conduit from which it was dispensed from the holding vessel. A significant portion of foam which is present at the time the carbonated beverage is dispensed from the vessel will be reabsorbed by the carbonated beverage by the time it is dispensed for the consumer.

However, neither the cooling or pressurization of the carbonated beverage alone is sufficient to satisfactorily reduce foam. The prior art does not describe an apparatus or process, of a portable nature, which provides for the dispensing of cooled, non-foamed carbonated beverages in an economical manner. Therefore there is a need for such apparatuses and processes.

SUMMARY OF THE INVENTION

The present invention relates to an apparatus for cooling a carbonated beverage from a keg and for continuously delivering non-foamed carbonated beverage. The apparatus includes a conduit that is attachable to the keg and which has a varying diameter. The conduit is submerged in a cooling fluid that is agitated by agitators to flow over the conduit for heat exchange. The agitators are positioned to provide an advantageous flow pattern over the conduit.

According to one aspect of the present invention there is provided an apparatus for cooling a carbonated beverage stored in a container and dispensing non-foamed carbonated beverage, the apparatus comprising:

- a housing defining a chamber having first and second openings;
- means attached to the container for maintaining the beverage under pressure in said container;
- a conduit located in the chamber, the conduit communicating with the container through said first opening, the conduit further communicating with the second opening for delivering said beverage from the chamber;
- cooling fluid located in said chamber for cooling the conduit; and
- at least two agitators for circulating the cooling fluid over the conduit, the at least two agitators being mounted in the chamber at opposing ends of the chamber and being laterally spaced.

According to another aspect of the present invention there is provided an apparatus for cooling a carbonated beverage stored in a container and dispensing non-foamed carbonated beverage, the apparatus comprising:

a housing defining a chamber having first and second openings;

pressurizing means attached to the container for maintaining the beverage under pressure in said container;

a conduit located in the chamber, the conduit communicating with the container through said first opening, the conduit further communicating with the second opening for delivering said beverage from the chamber;

a perforated vessel mounted in the chamber, said perforated vessel surrounding the conduit;

cooling fluid located in said chamber for cooling the conduit, the cooling fluid including solid fragments, said fragments being substantially larger than the perforations in said vessel;

an agitator for circulating the cooling fluid over the conduit; and a pressure valve located between the conduit and the container for detecting a predetermined pressure rating in said container.

According to another aspect of the present invention there is provided an apparatus for cooling a carbonated beverage stored in a container and dispensing non-foamed carbonated beverage, the apparatus comprising:

a housing defining a chamber having first and second openings;

means attached to the container for maintaining the beverage under pressure in said container;

a conduit located in the chamber, the conduit communicating with the container through said first opening, the conduit further communicating with the second opening for delivering said beverage from the chamber, the conduit having a length of substantially at least 70 feet and having regions of decreased inner diameter at regions at substantially 5 feet and at substantially 65 feet along said length;

cooling fluid located in said chamber for cooling the conduit; and an agitator for circulating the cooling fluid over the conduit.

According to yet another aspect of the present invention there is provided a method of cooling a carbonated beverage and continuously delivering non-foamed a carbonated beverage, the method comprising the following steps:

providing a conduit having regions of decreased inner diameter for delivering the beverage from the container;

pressurizing the beverage in the container to induce flow of the beverage into the conduit;

providing a cooling fluid;

agitating the cooling fluid to continuously flow over the conduit; and delivering the beverage through the regions of decreased inner diameter to entrain carbon dioxide gas into the beverage.

DESCRIPTION OF THE DRAWINGS

The invention is described with reference to the accompanying drawings in which.

Like reference characters refer to like parts throughout the description of the drawings.

DESCRIPTION OF PREFERRED EMBODIMENTS

The description which follows is of an apparatus for cooling and dispensing beer but it is to be understood that the apparatus of the invention is not limited to one for cooling and dispensing beer. The apparatus can be used to cool and dispense other carbonated beverages such as non-alcoholic and alcoholic drinks. The apparatus can for example be used to dispense carbonated soft drinks and spritzers.

FIGS. 1–4 show a first embodiment of the present invention.

Figure 1:
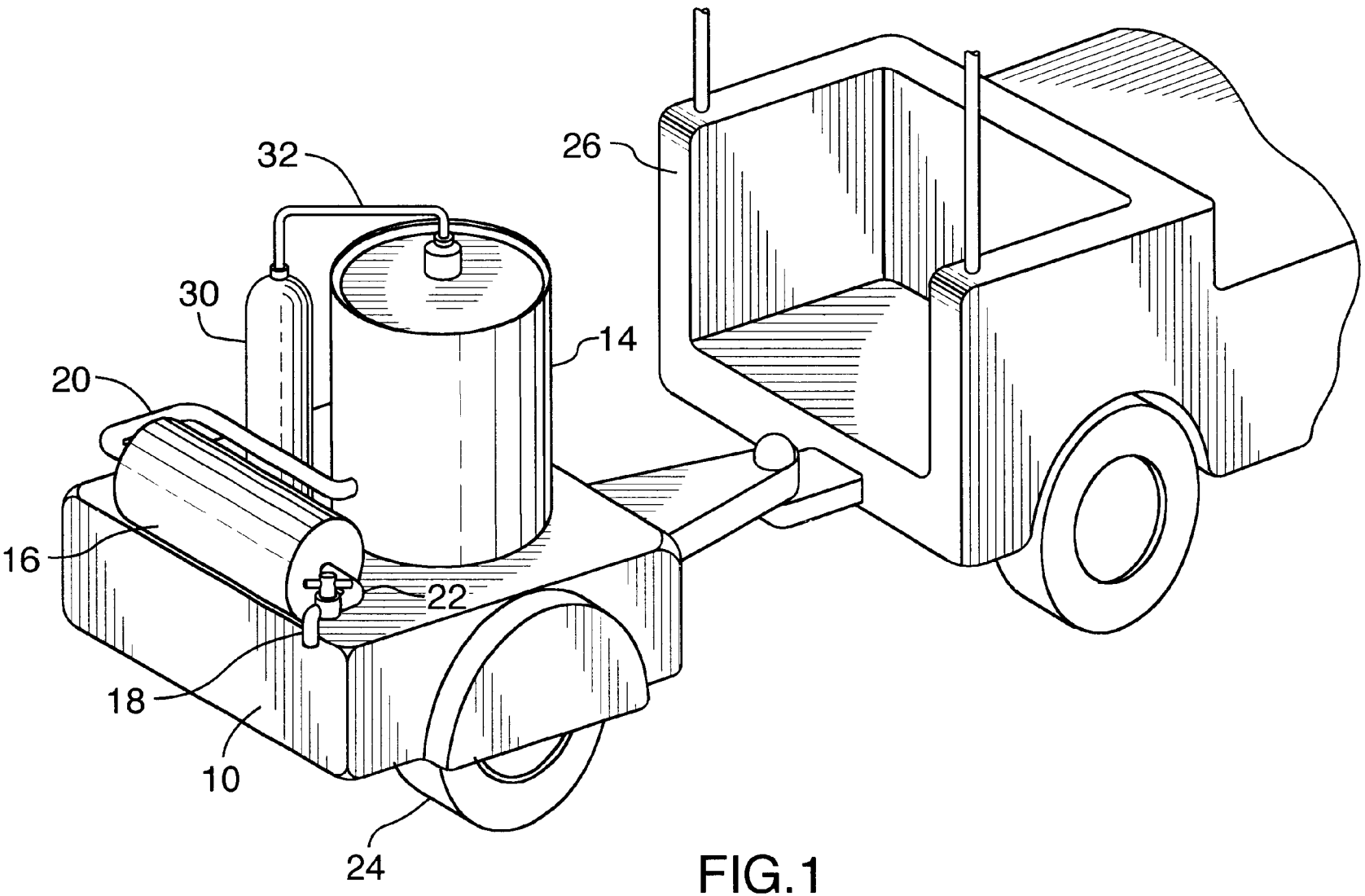
FIG. 1 is a perspective view of a first embodiment of the present invention mounted on a trailer.

With reference to FIG. 1, a trailer 10 holds a keg 14, a cooler 16 and a tap 18 from which beverage within the keg and cooler discharge. The keg 14 contains beer which flows through a hose 20 to the cooler where it is chilled. From the cooler, the beer flows through a second hose 22 to the tap 18 from which it discharges. Preferably hoses 20 and 22 are composed of braided polyvinyl chloride.

The trailer 10 is mounted on wheels 24 so that it can be towed by a motorized golf cart 26. The keg 14 can be removed from the trailer when it is empty and replaced by another full keg.

Beer within the keg 14 is maintained under pressure by means of so called "beer gas" stored in a conventional pneumatic or gas cylinder 30. Beer gas is usually composed of from about 65 to 75 percent nitrogen and the remainder carbon dioxide. The gas is introduced into the interior of the keg 14 through a hose 32 which extends from the cylinder to the keg. A nozzle and pressure gauge (not illustrated) both of conventional construction are provided in the gas line so that the pressure within the keg can be monitored and controlled. A compressor can also be used.

Figure 2:
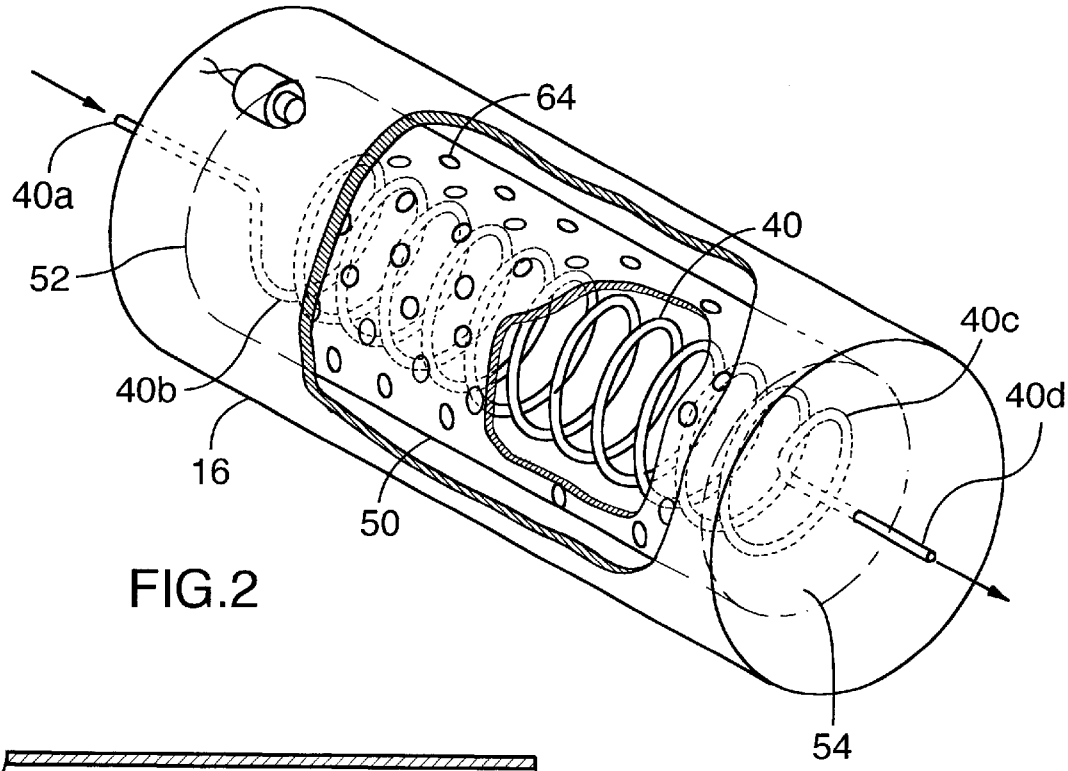
FIG. 2 is a perspective view, partly cut away, of a cooling coil of the first embodiment.

With reference to FIG. 2, a conduit or coil 40 extends through the cooler 16. The coil has a point of entry 40*a* at which beer enters the coil. From the point of entry, the beer enters an upstream segment 40*b* and from the upstream segment, the beer flows to a downstream segment 40*c*.

Figure 3:
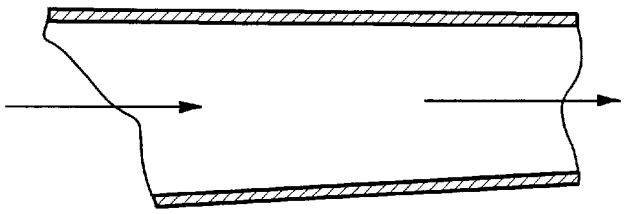
FIG. 3 is a side view, cut away and enlarged scale, of a portion of the cooling coil of the first embodiment.

The inner diameter of the coil decreases downstream of the flow of beer. In FIG. 3 the inner wall of the coil diminishes gradually but the decrease may be abrupt. In the latter event, the inner diameter of the upstream segment is greater than that of the downstream segment. The two segments may be interconnected by a joint of conventional construction.

Preferably, the two segments of the coil are composed of stainless steel and each has a constant inner diameter. The inner diameter of the coil at the point of entry 40*a* is about ⅜ inch as is that of hose 20 through which the beer flows to the cooler from the keg.

The upstream segment 40*b* has an inner diameter of about ¼ inch while the downstream segment has an inner diameter of 3⁄16 inch.

The upstream segment should be about 60 to about 70 feet in length measured along the longitudinal axis of the coil. Any shorter than 60 feet and the volume of beer at the desired temperature will diminish while any longer than 70 feet, while permissible, will necessitate a higher pressure of beer gas to cause the beer to flow at a satisfactory rate. The preferred pressure of beer gas is about 45 to 55 p.s.i. The pressure of beer gas is most preferably 47 p.s.i.

The downstream segment should be about 3 feet in length measured along the longitudinal axis of the coil. Significantly longer and the flow of beer will diminish to a trickle and significantly shorter and foaming becomes a problem.

The downstream segment terminates at the tap and accordingly it will straighten at 40*d* at its downstream end. While it is desirable that the downstream segment be substantially entirely within the cooler, the apparatus will still work if the downstream segment is partly within and partly outside the cooler.

Figure 4:
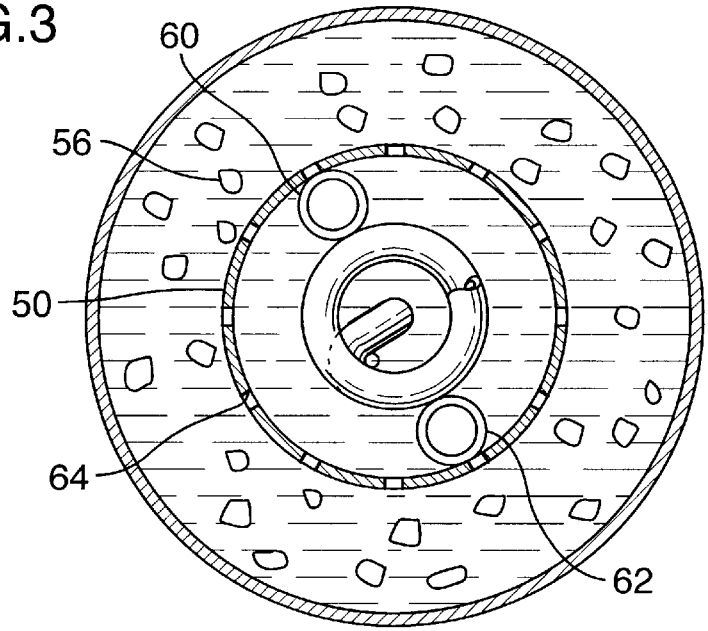
FIG. 4 is a cross-section of the coil of the first embodiment.
Figure 5:
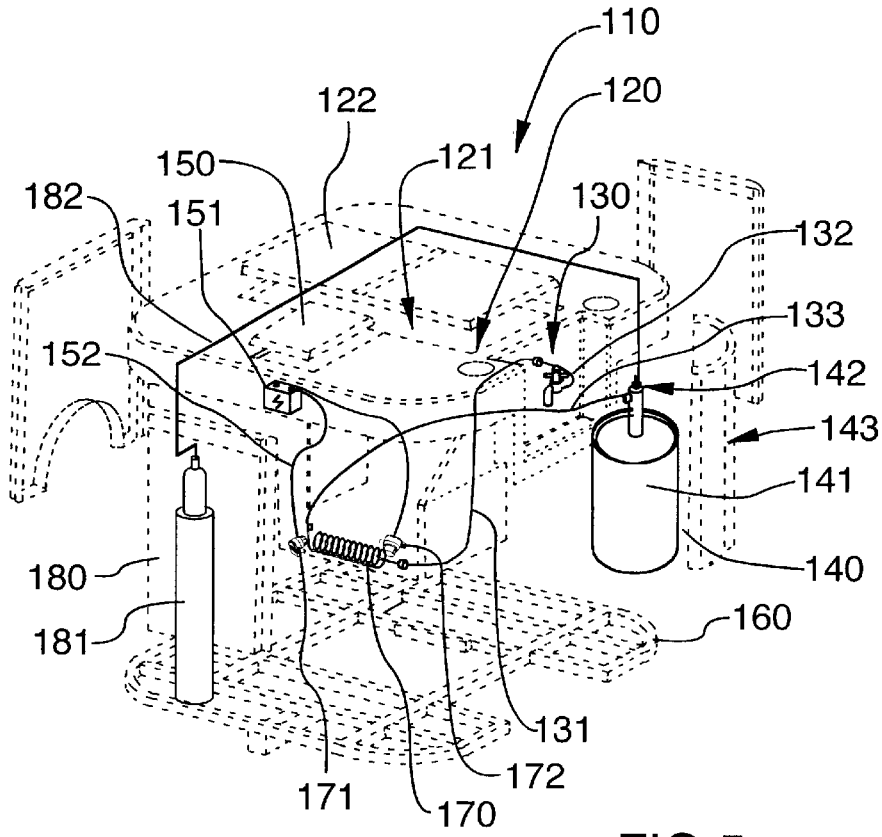
FIG. 5 is an exploded view of the housing of the second embodiment.

With reference to FIGS. 2 and 4, the coil is mounted within a perforated vessel or cylinder 50 which is closed at both ends 52, 54. The cylinder is mounted within cooler 16 which has solid sides and end walls.

The cooler contains water and particles of ice 56 which serve to cool the beer within the coil. A drain (not illustrated) is provided at the bottom of the cooler through which the water can be drawn off. A faucet (not illustrated) is provided in the discharge line for controlling the flow from the drain.

An opening (not illustrated) is formed on the top of cooler for admission of fresh water and ice particles. The opening is closed by a lid (not illustrated) for preventing the contents of the vessel from spilling out when the trailer is moving.

Two submersible pumps 60, 62 are mounted within the vessel to cause the water to circulate. The water circulates freely around the pumps but the ice particles are prevented from contacting and damaging the pump because they are too large to penetrate through the perforations 64 in cylinder 50.

A pump suitable for causing the water and ice particles to circulate is submersible pump model V500 no. 4204 sold by Attwood Company. The pump is powered by a 12 volt battery. The battery is mounted on the trailer so that the trailer is completely portable and self-contained.

With reference to FIG. 1, cooled beer flows from the coil to tap 18. The tap is of conventional construction and is spring-loaded closed. Such a tap ensures that pressure within the line through which beer flows is maintained at the desired value at all times except when the tap is opened to dispense beer.

The beer cooler described above is capable of cooling beer from ambient temperature to a temperature in the range of about 32 to 34 degrees F. This is the range generally favoured by most consumers of beer brewed in North America. Thus the temperature of the beer in the keg will be ambient while the temperature at tap 18 will be about 32 to about 34 degrees.

The conditions which have an effect on the amount of foam which discharges from the tap are as follows:

1. The pressure of gas within the keg. The pressure should be maintained at about 45 to 55 p.s.i, preferably 47 p.s.i. The gauge which measures the pressure within the keg should be monitored to ensure that the pressure remains within this range. It is believed that if the pressure is below this range, carbon dioxide in the beer comes out of solution and combines with beer as foam. If the pressure is above this range, the keg must be constructed of heavier and stronger material at added cost and with no significant benefit.
2. The inner diameter of the coil. The diameter must decrease as the beer flows downstream. As indicated above the inner diameter of the coil at the point of entry into the perforated cylinder 50 should preferably be about ¼ inch and at the point of exit from the cylinder about 3⁄16 inch.
3. The length of the coil. The upstream segment should be over about 60 feet long and less than about 70 feet. The downstream segment should be about 3 feet long.

A second embodiment of the apparatus is shown in FIGS. 5 to 15. This embodiment is preferably for use with beer, although it can be for use with other carbonated and non-carbonated beverages.

With reference to FIGS. 5, 9, 10 and 11, a housing 110 is preferably composed of fiberglass, but may be of any appropriate material known to those skilled in the art. The housing 110 is mounted on a frame 160 which is preferably composed of steel or aluminum to provide structural support for the housing. The frame 160 is preferably equipped with wheels and a hitch to enable it to be towed behind a golf cart, all terrain vehicle, truck or any other such vehicle with suitable towing capabilities. The preferred embodiment of the housing 110 preferably defines 4 chambers, 120, 140, 150 and 180 but in another embodiment the housing may define as few as one chamber.

Chamber 120 is watertight. The housing 110 defines an opening 121 which permits a mixture of preferably water and ice to be poured into the chamber 120. A lid 122 seals chamber 120. Other appropriate cooling liquids or fluids are also acceptable. A coil 170, described in more detail below, is mounted to the bottom of the chamber 120 and is surrounded by the liquid and ice mixture. Agitators 171 and 172 are located in chamber 120 for agitating the water and ice. Preferably the agitators are submersible pumps. In alternate embodiments it is possible to locate the keg outside of the housing in a manner similar to that described with the first embodiment. The housing 110 defines openings 130 which run from the chamber 120 to the outer wall of the housing 110. These openings 130 permit lengths of hoses 131 to run from the coil 170 to taps 132. Hose 131 is preferably 3⁄16th inch in diameter and four to five feet in length. Hose 133 is preferably ⅜th inch in diameter and five to ten feet in length. The hoses 131 and 133 are preferably composed of braided polyvinyl chloride.

The chamber 140 provides a hinged access door 143 which permits one or more beer kegs 141 to be placed inside. Hose 133 connects the coil 170 to the keg 141. Mounting brackets plus adjustable straps (not illustrated) are provided to secure keg 141 in place. A keg coupler 142 is threadably received into a port on the top of the keg 141. The keg coupler 142 provides a blow out valve with a preset pressure limit of 60 p.s.i., significantly higher than the pressure limit of standard North American keg couplers. Hose 182 attaches to the keg coupler and is preferably composed of braided polyvinyl chloride.

Chamber 180 provides a housing for the gas cylinder 181 or compressor in a secure manner. A hinged door is provided to enable easy access to remove and replace cylinder 181. Hose 182 is also attached to a pressurizing means 181 housed in chamber 180. The pressurizing means is preferably so called "beer gas" stored in a conventional pneumatic or gas cylinder 181. Beer gas is usually composed of from about 65 to 75 percent nitrogen and the remainder carbon dioxide. Any gas can be used which does not affect the flavour of the beverage stored in the keg 141, for example pure carbon dioxide or even compressed air. The gas is introduced into the interior of the keg 141 through hose 182 which extends from the cylinder 181 to the keg 141. A nozzle and pressure gauge (not illustrated) both of conventional construction are provided in the gas line so that the pressure within the keg can be monitored and controlled. An alternate means to pressurize the interior of the keg 141 is through the use of a compressor instead of a pre-pressurized gas cylinder.

Chamber 150 provides a housing for a portable power source 151 capable of operating the agitators 171 and 172. The power source 151 is preferably a 12 volt battery but may be any form of portable power, such as a generator. The power source 151 is connected to the agitators 171 and 172 by way of wiring 152. The wiring passes into chamber 120 and is waterproof. The opening through which the wire passes is sealed around the wire such that the liquid and ice mixture in chamber 120 does not seep out.

Figure 6:
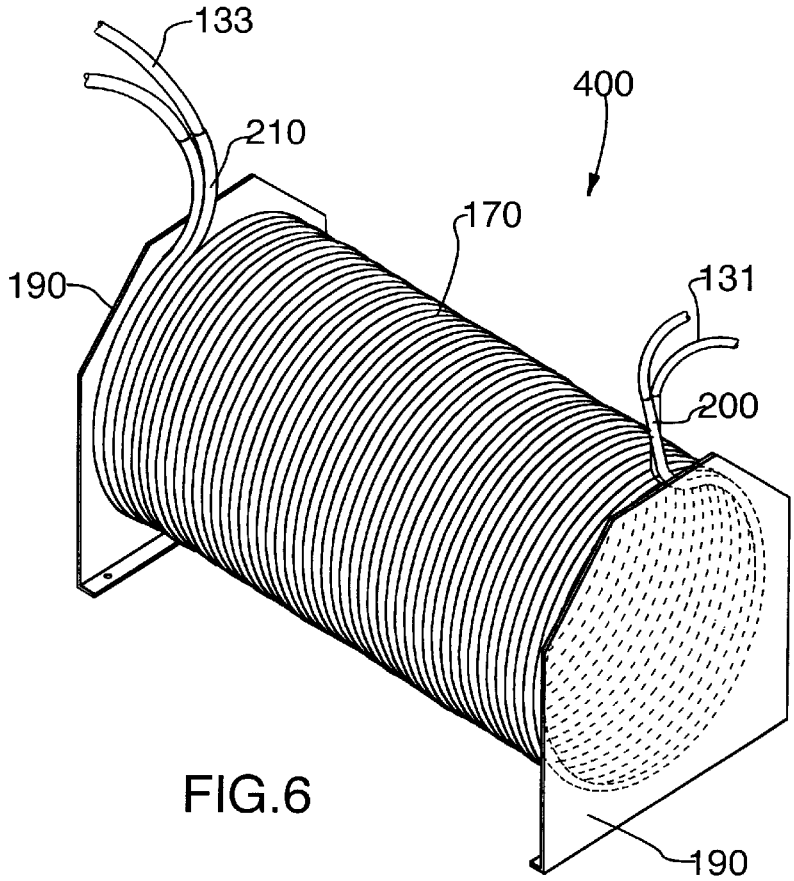
FIG. 6 is a perspective view of the coil of the second embodiment.
Figure 7:
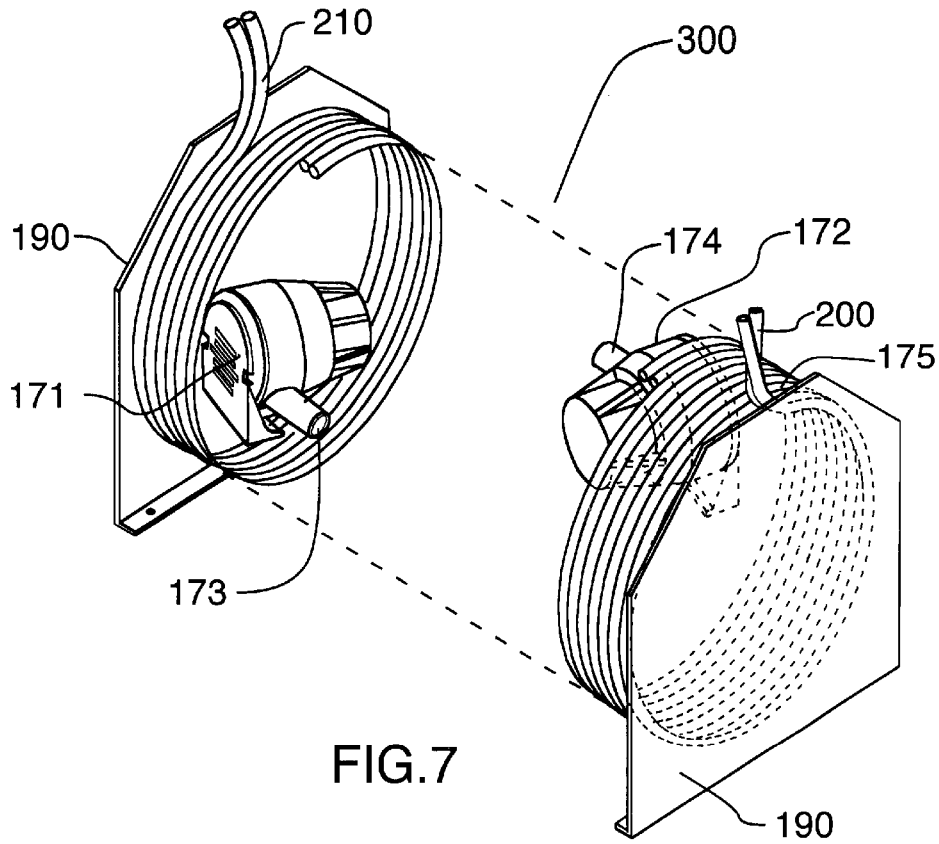
FIG. 7 is a perspective view with portions cut away of the agitators of the second embodiment.

Conduit 400 comprises hoses 131 and 133 and coil 170 and is shown in FIG. 6. Other conduits that permit the flow of a fluid or liquid and which permit satisfactory heat exchange to cool the beverage flowing through the conduit are also acceptable. For example any form of metal or steel tubing that permits heat exchange is acceptable. Notable exceptions are copper and lead which can poison the beverage. Conduit 400 is preferably substantially 70 feet long. Slight variations of the length of the conduit are possible. Preferably the conduit is ⅜ inch for the first 5 feet. Preferably the inner diameter of the conduit is decreased to ¼ inch at the 5 foot point along the length of the conduit. The inner diameter is preferably ¼ inch from the 5 foot point to the 65 foot point along the length of the conduit and is described herein as coil 170. Preferably the inner diameter of the conduit is decreased to 3⁄16 inch at the 65 foot point along the length of the conduit. The inner diameter is preferably 3⁄16 inch from the 65 foot point to the 70 foot point along the length of the conduit. The first 5 feet and the last 5 feet of the conduit are preferably composed of braided polyvinyl chloride and have been described herein as hoses 131 and 133. In alternate embodiments the total length of the conduit can be in the range of 60 to 70 feet. If the conduit is shorter than 60 feet then the volume of beer at the desired temperature will diminish. If the conduit is longer than 70 feet, a higher pressure of beer gas is required to cause the beer to flow at a satisfactory rate. As shown in FIG. 6, two or more conduits 170 can be wound into a coil thereby permitting more than one beer line to be cooled simultaneously. Preferably, conduit 400 is composed of stainless steel, although any appropriate material or combinations of materials may be used the selection of which will be apparent to one skilled in the art.

Figure 8:
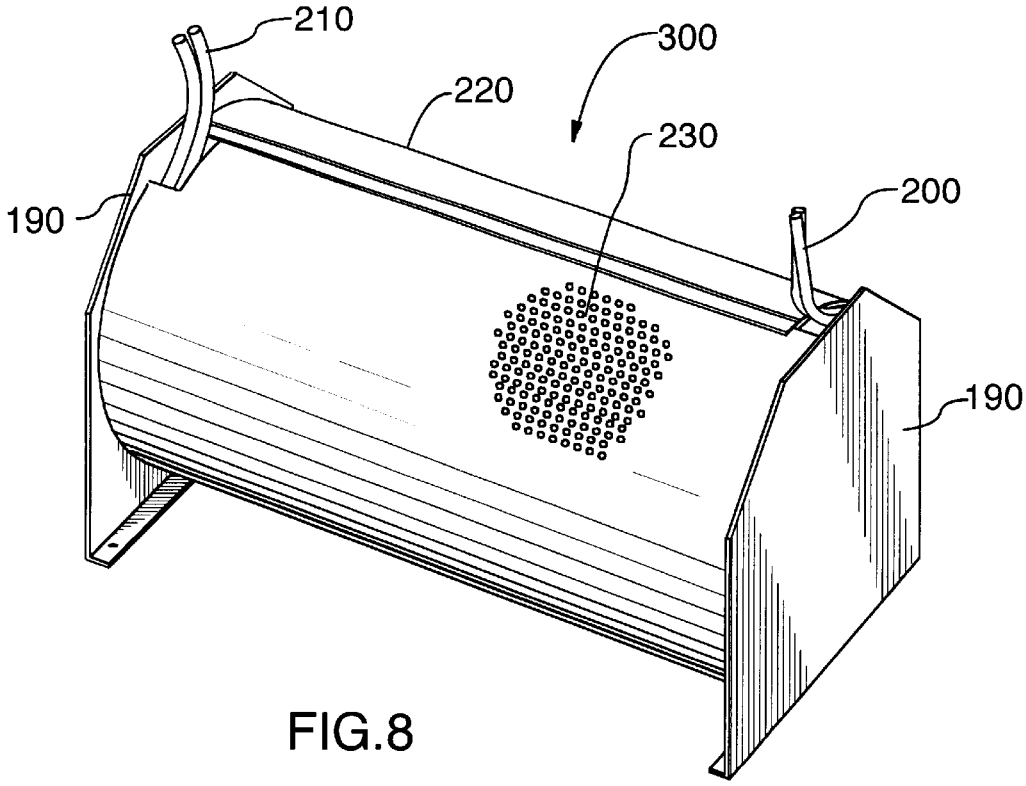
FIG. 8 is a perspective view with portions cut away of the perforated vessel surrounding the cooling coil of the second embodiment.
Figure 9:
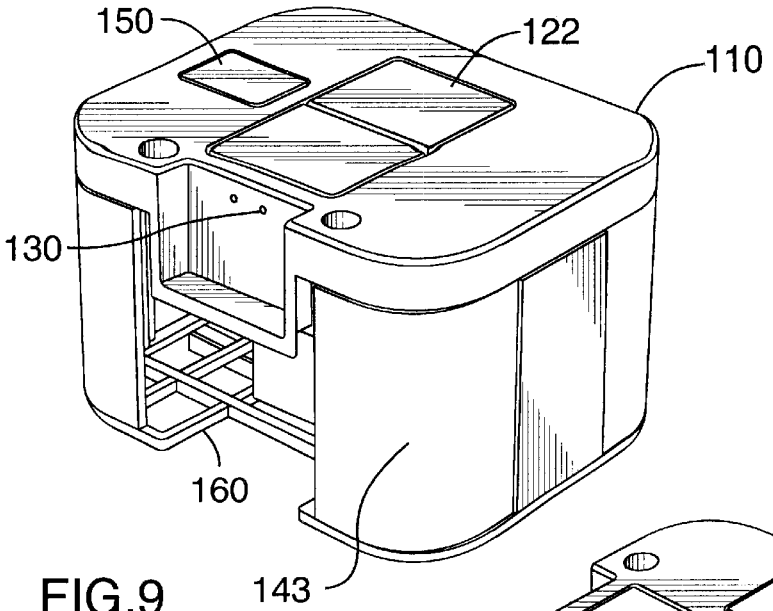
FIG. 9 is a perspective view of the housing of the second embodiment.
Figure 10:
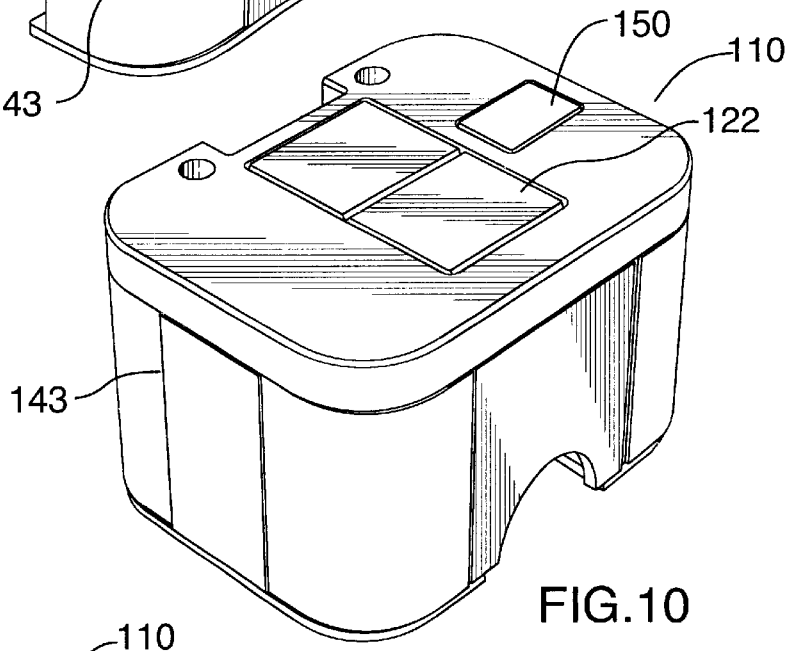
FIG. 10 is a perspective view of the housing of the second embodiment.
Figure 11:
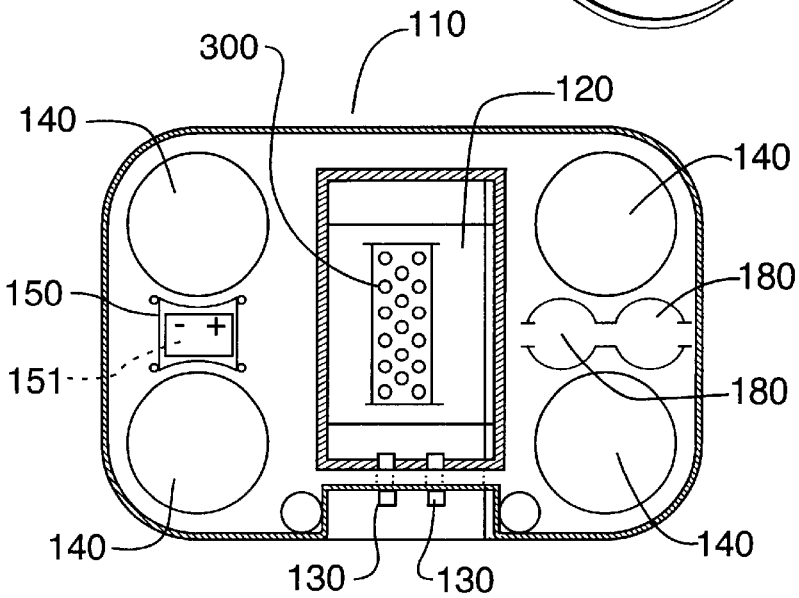
FIG. 11 is a plan view of the housing of the second embodiment.
Figure 12:
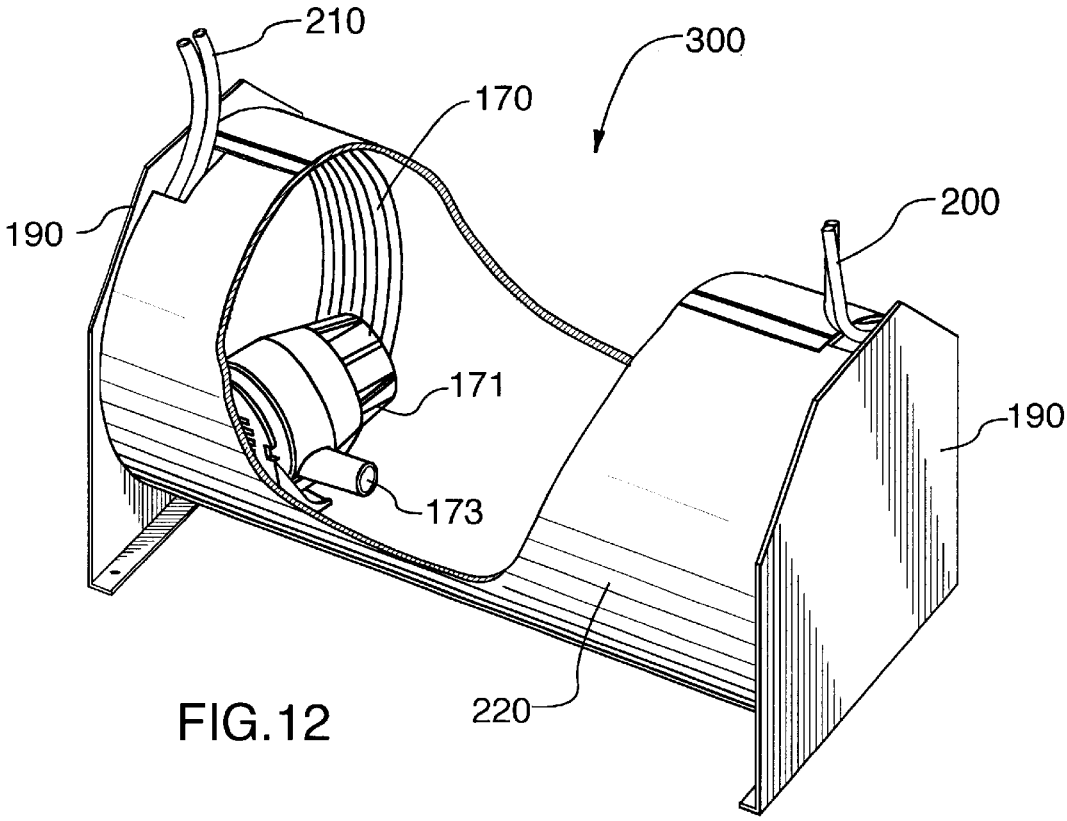
FIG. 12 is a perspective view with portions cut away of the coil and an agitator of the second embodiment.
Figure 13:
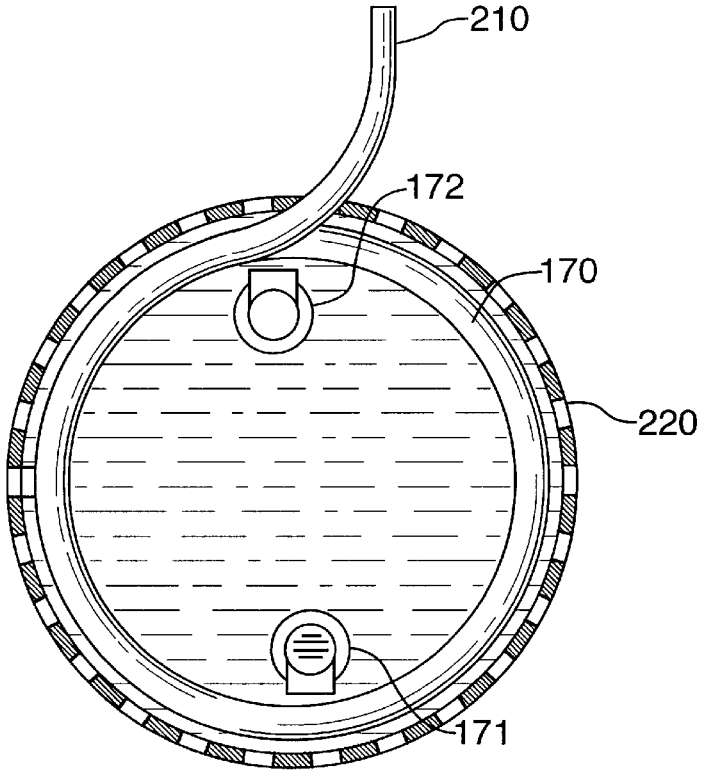
FIG. 13 is a cross section of the coil and the perforated vessel of the second embodiment.
Figure 14:
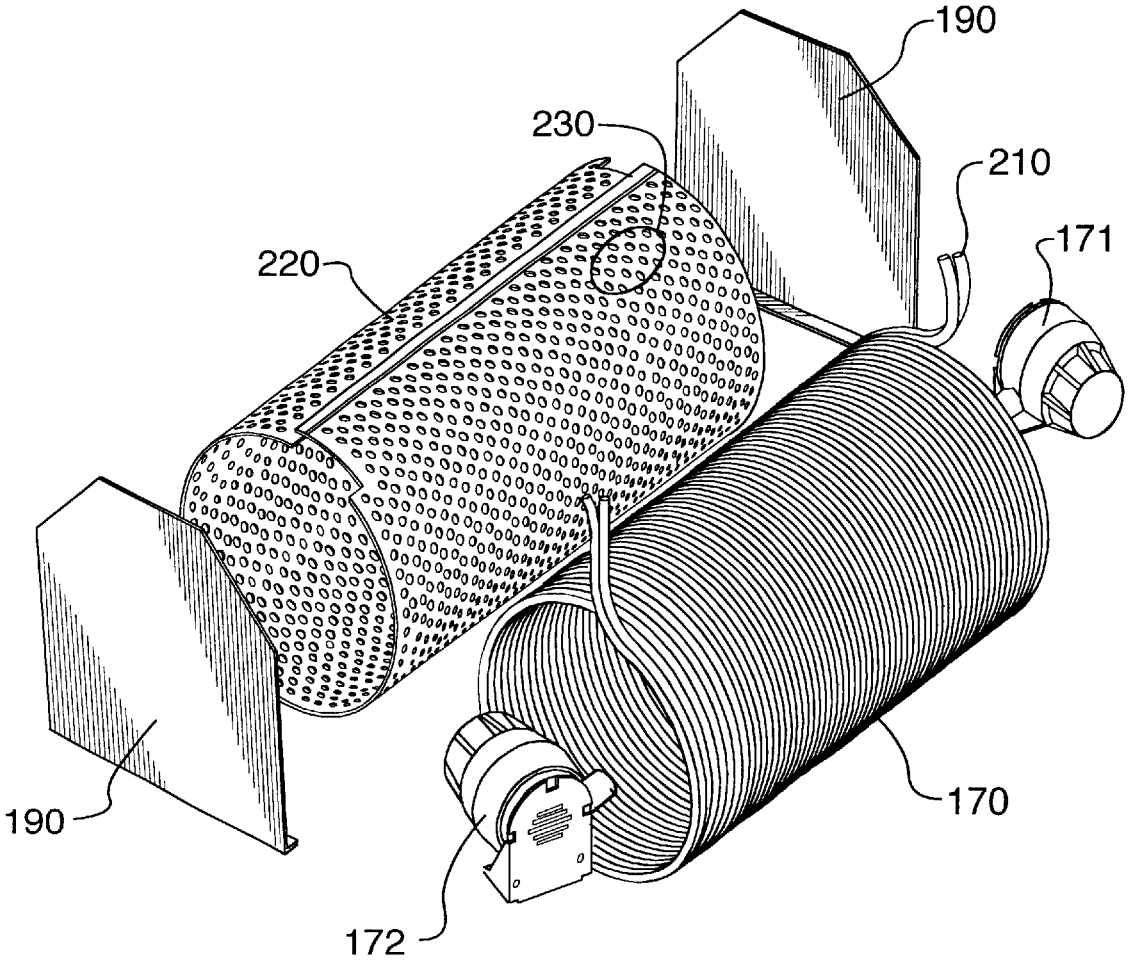
FIG. 14 is a detailed view of the coil assembly of the second embodiment.
Figure 15:
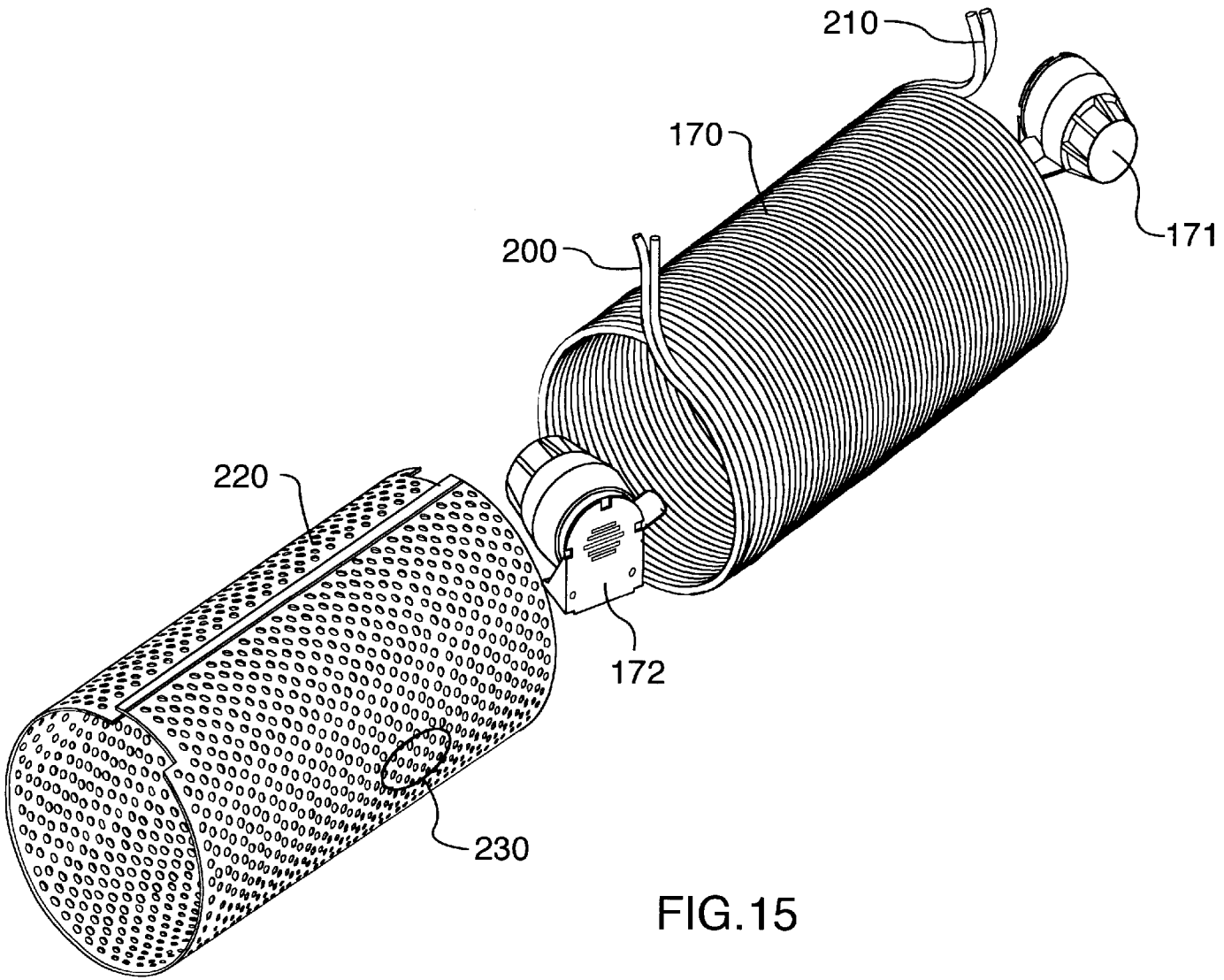
FIG. 15 is an exploded view of the coil assembly of the second embodiment.

Coil 170 is mounted inside a perforated vessel 300 with solid anterior and posterior side plates 190. Perforated vessel 300 is shown in FIGS. 8, 14 and 15 and is described in greater detail below. The inner circumference of coil 170 wound as a coil is of sufficient size to permit the placement of agitators 171 and 172 therein. Agitators 171 and 172 are shown in FIGS. 7 and 12–15 and are described in greater detail below.

The preferred pressure of beer gas in the container 141 is about 45 to 55 p.s.i. Most preferably, the pressure is 47 p.s.i. Hose 133 is preferably ⅜th inch in diameter and decreases to ¼ inch inner diameter at the point of connection 210 to the coil 170, however the decrease may also be abrupt. The two segments may be interconnected by a joint of conventional constructions. Hose 133 is preferably of a length in the range of five to ten feet. The hose 133 is of a significantly lesser diameter than the container 141. As such any beer which is forced into hose 133 is subject to greater pressures which begins to entrain gas which has separated from the beer.

The hose 131 is connected to coil 170 at a connection 200. The two segments may be interconnected by a joint of conventional constructions. The downstream end of hose 131 connects to a dispensing means 132. Hose 131 is preferably ¼ inch in diameter and tapers to 3⁄16th inch diameter at dispensing means 132, however the decrease may also be abrupt. Hose 131 is preferably of a length in the range of four to five feet. Significantly longer and the flow of beer will diminish to a trickle and significantly shorter and foaming becomes a problem. The hose 131 is of a lesser diameter than the coil 170. As such any beer which is forced into hose 131 is subject to greater pressures than the beer was subject to in coil 170. As such any remaining separated gas is reintroduced into the beer. While it is desirable that hose 131 be substantially entirely within the chamber 120, the apparatus will still work if hose 131 is partly within and partly outside chamber 120.

It is preferable that only three sections of a reduced diameter hosing is required to fully defoam the beer, however, additional sections of hose of a reducing diameter can be added until the beer is defoamed to a desired extent. Alternatively, if the beer in the container 141 is not subject to significant agitation or foam inducing conditions, fewer sections of hose with a reducing diameter will be necessary to defoam the beer.

The coil 170 is surrounded by a perforated vessel or cylinder 220 shown in FIGS. 8, 14 and 15 which is closed on the anterior and posterior sides with solid metal plates 190. The cylinder 220 and the sides are preferably made of a resilient non-corrosive substance such as stainless steel or plastic, however, any appropriate substance can be used and will be known to a person skilled in the art. The vessel 300 has openings sufficient to permit the connecting ends of the coil 210 and 200 to protrude there from. The vessel 300 is preferably mounted on the bottom and in the center of chamber 120, but may be mounted anywhere within said chamber.

The perforations 230 are preferably ⅛th inch in diameter and evenly spaced ⅛th inch apart across the entire surface of the perforated vessel 220. The perforations filter ice particles from the liquid and ice mixture in order that the agitators 171 and 172 are not damaged from drawing large ice particles into the their intake ports 175. The preferred sizing and spacing of the perforations permits a sufficient volume of liquid to be drawn through the perforated vessel 220 by way of the agitators. However, any configuration of perforation size and spacing may be used so long as the agitators are not being damaged and can draw sufficient liquid to provide adequate cooling of the beer in the coil 170. If the agitators have adequate filters on their intake ports 175, the perforated vessel 220 may not be necessary at all.

Agitators 171 and 172 are shown in FIG. 7 and 12–15. Preferably, the agitators are submersible pumps. Most preferably, the pumps are capable of processing 500 gallons of water per hour. However, submersible pumps that process more or less water per minute, or even only one submersible pump may be used provided they or it are capable of sufficiently agitating the liquid and ice mixture to cool the beer in the coil 170 and there is a sufficient power supply to operate them or it. Alternatively, the agitators may not need to be submersible pumps (not illustrated) and may be pumps located externally to chamber 120. Such externally located pumps would be connected to chamber 120 by way of hoses which port into chamber 120. Such externally located pumps could agitate the water and ice mixture by way of drawing in said mixture through an intake port hose and expelling it through an outtake port hose.

Preferably, agitators 171 and 172 are mounted on the anterior and posterior side plates 190 of the perforated vessel 300. The mounting of the pumps in such a manner places them inside the inner circumference of coil 170. Preferably, agitators 171 and 172 are oriented in such a manner that their respective discharge nozzles 173 and 174 are horizontally and laterally diagonally spaced along the longitudinal axis of the coil 170 and directed toward the centre thereof Agitator 171 is located on the same side of the coil 170 as the connection point 210. Agitator 172 is located on the same side of the coil 170 as the connection point 200. The preferred position of the agitators imparts a vorticular flow to the liquid and ice mixture which provides for maximum cooling of the beer in the coil 170, while also minimizing the draw on the portable power supply 151 to operate the agitators. Alternatively, the agitators may be only laterally or horizontally spaced along the longitudinal axis of the coil 170 with their respective discharge nozzles 173 and 174 pointing toward the centre thereof. In addition, the discharge nozzles 173 and 174 may be directed in any direction suitable for sufficiently agitating the liquid and ice mixture to adequately cool the beer.

The intake ports 175 on the agitators are positioned to abut the walls of the coil 170. The intake ports 175 draw liquid through the perforated vessel 300 and over the exterior of coil 170. The perforated vessel 300 prevents large ice particles from the liquid and ice mixture from being drawn into the agitators 171 and 172.

An agitator suitable for causing the liquid and ice mixture to agitate is submersible pump model V500 no. 4204 sold by Attwood Company. The agitators 171 and 172 are powered by a 12 volt battery and draws 1.5 amperes current. The portable power supply 151 may be a battery of sufficient voltage or any other appropriate power source known to those skilled in the art. The portable power supply 151 is located in chamber 150. Wiring 151 is connected to the power supply 151, is routed through chamber 120 and is connected to agitators 171 and 172. Wiring 151 is shielded against contact with the liquid and ice mixture.

The keg 141 contains beer at an ambient temperature. The keg 141 is pressurized by way of a gas cylinder 181 or compressor which forces compressed gas through hose 182, into the keg coupler 142 which is threadably received into keg 141. The pressure must be sufficient to force the beverage into and through the entire length of coil 170 and hoses 133 and 131. It is preferable to use pressure in the range of 45 to 55 p.s.i., in particular 47 p.s.i. is ideal.

The beer flows from keg 141, through the keg coupler 142 to a hose 133. The beer flows from the hose 133 to the coil 170. From the coil 170, the beer flows through a second hose 131 to the tap 132 from which the beer may be selectively discharged. Any gases which have escaped from the beer while it is stored in the keg 141 are entrained into the beer by way of forcing the beer under pressure through hose 133, coil 170 and hose 131. At each step the diameter of hose or conduit through which the beer is forced is reduced.

The coil 170 is cooled by the liquid and ice mixture as it is agitated around the coil. Rapid and thorough heat exchange along the entire length of the coil 170 is achieved by the continuous and uninterrupted flow of the chilled liquid portion of said mixture over the coil. The positioning of the agitators is such the agitators discharges the chilled liquid of said mixture onto the side plates 190. The liquid impacts the side plates 190 with sufficient power to be deflected over the exterior of coil 170 and out through the perforations 230. The liquid exits the perforations and with sufficient power to impart a vorticular flow pattern with its nexus located at the centre of the longitudinal axis of the coil 170. The vorticular flow pattern circulates the chilled liquid of said mixture such that there is maximum uniform surface exposure to the coil 170 thereby ensuring that the entire coil is evenly cooled. As well, the vorticular flow pattern ensures the entire liquid of said mixture is utilized to cool the coil 170, not just that portion of chilled liquid in direct proximity with the coil.

The beer is preferably cooled to a temperature in the range of 32 to 34 degrees Fahrenheit. As it passes through the coil the cooling of the beer further reduces any foaming and permits more of the separated gases to be reintroduced into the beer.

Non-foamed beverage is continuously delivered from the conduit to the exterior of the housing by way of a dispensing tap. The combined effect of cooling the conduit by the circulation over the coil of the cooling fluid and the delivery of the beverage through diminishing diameters of the conduit to augment the pressure allowed for the continuous delivery of non-foamed beverage even under hot conditions and where the beverage has been agitated. Most preferably, the taps are spring loaded to prevent them from jarring open over rough terrain.

It should be noted that the cooler of the subject invention may be used to cool any carbonated beverage and may be stationary as well as mobile. The drawings and description are intended to be illustrative of one way in which the subject invention may be put into practice. They are not intended however to limit the scope of the invention.

I claim:

1. An apparatus for cooling a carbonated beverage stored in a container and dispensing non-foamed carbonated beverage, the apparatus comprising:

a housing defining a chamber having first and second openings;

means attached to the container for maintaining the beverage under pressure in said container;

a conduit located in the chamber, the conduit communicating with the container through said first opening, the conduit further communicating with the second opening for delivering said beverage from the chamber;

cooling fluid located in said chamber for cooling the conduit; and at least two agitators for circulating the cooling fluid over the conduit, the two agitators being mounted in the chamber at opposing ends of the chamber and being laterally spaced.

2. An apparatus according to claim 1 wherein the conduit is a coil.

3. An apparatus according to claim 1 wherein the cooling fluid is water.

4. An apparatus according to claim 1 wherein means are attached to the coil for selectively dispensing the beverages.

5. An apparatus according to claim 1 wherein the housing defines a plurality of chambers.

6. An apparatus according to claim 1 wherein the agitators generate a vorticular flow pattern.

7. An apparatus according to claim 1 wherein the agitators are submersible pumps.

8. An apparatus according to claim 1 wherein the housing is portable.

9. An apparatus according to claim 1 wherein the conduit is made of stainless steel.

* * * * *